US008267238B2

(12) United States Patent
Uesaka et al.

(10) Patent No.: US 8,267,238 B2
(45) Date of Patent: Sep. 18, 2012

(54) BANKNOTE DEPOSITING MACHINE AND BANKNOTE DEPOSITING METHOD

(75) Inventors: Sadaaki Uesaka, Kanzaki-Gun (JP); Teruo Sudo, Chiba (JP); Keishi Kobayashi, Siso (JP)

(73) Assignee: Glory Ltd., Himeji-Shi (JP)

( * ) Notice: Subject to any disclaimer, the term of this patent is extended or adjusted under 35 U.S.C. 154(b) by 37 days.

(21) Appl. No.: 12/404,688

(22) Filed: Mar. 16, 2009

(65) Prior Publication Data

US 2010/0230232 A1 Sep. 16, 2010

(51) Int. Cl.
*G07F 7/04* (2006.01)
*G07F 9/10* (2006.01)

(52) U.S. Cl. ..... 194/206; 194/217; 194/350

(58) Field of Classification Search ..... 194/206, 194/205, 215, 216, 217, 344, 350; 902/8, 902/9, 11, 12, 13; 209/534; 235/379
See application file for complete search history.

(56) References Cited

U.S. PATENT DOCUMENTS

| | | | | |
|---|---|---|---|---|
| 4,602,332 | A * | 7/1986 | Hirose et al. | 705/43 |
| 4,830,742 | A * | 5/1989 | Takesako | 209/534 |
| 6,749,053 | B2 * | 6/2004 | Ikuta | 194/206 |
| 7,232,024 | B2 * | 6/2007 | Mazur et al. | 194/207 |
| 7,469,818 | B2 * | 12/2008 | Saltsov et al. | 232/16 |
| 2006/0151281 | A1 * | 7/2006 | Kuroiwa et al. | 194/206 |
| 2007/0267481 | A1 * | 11/2007 | Takahashi | 235/379 |

FOREIGN PATENT DOCUMENTS

JP 2001-067526 A1 3/2001

* cited by examiner

*Primary Examiner* — Mark Beauchaine
(74) *Attorney, Agent, or Firm* — Burr & Brown

(57) ABSTRACT

A banknote depositing machine has a receiving unit which takes in inserted banknotes, a stacking unit which stacks said banknotes, a transporting unit which transports the banknotes between said receiving unit and said stacking unit, a recognition unit which is provided in said transporting unit, and identifies and counts the banknotes, a storing unit which receives the banknotes from said stacking unit and stores the banknotes, and a controlling unit which, if said recognition unit has judged a banknote as abnormal, stops said transporting unit.

14 Claims, 10 Drawing Sheets

Date : MM/DD/YYYY
Time : AM/PM 00:00

| | |
|---|---|
| -Store Number | XXXXX |
| -Register Number | XXX |
| -Cashier Number | XXXX |
| -Declared Amount $ | XXXX.00 |

Transaction # XXX / Date : MM/DD/YYY/Time : AM/PM 00 : 00

| | | | |
|---|---|---|---|
| Currency : | | | |
| | $ 1 | XXX *(XXX) | $XXX.00 |
| | $ 5 | XXX *(XXX) | $XXX.00 |
| | $ 10 | XXX *(XXX) | $XXX.00 |
| | $ 20 | XXX *(XXX) | $XXX.00 |
| | $ 50 | XXX *(XXX) | $XXX.00 |
| | $100 | XXX *(XXX) | $XXX.00 |
| Currency Total | | XXX *(XXX) | $XXX.00 |
| Coin : | | | |
| | 01¢ | *(XXX) | $XXX.00 |
| | 05¢ | *(XXX) | $XXX.00 |
| | 10¢ | *(XXX) | $XXX.00 |
| | 25¢ | *(XXX) | $XXX.00 |
| Coin Total | | *(XXX) | $XXX.00 |
| Non Cash Items : | | | |
| | Check | | $XXX.00 |
| | Others | | $XXX.00 |
| Non Cash Total | | | $XXX.00 |
| Cash Total | | | $XXX.00 |
| | D.B | | $XXX.00 |
| | Balance | | ± $XXX.00 |

*( ) are input manually

FIG. 10

BANKNOTE DEPOSITING MACHINE AND BANKNOTE DEPOSITING METHOD

BACKGROUND OF THE INVENTION

A retail store such as a supermarket has installed a money depositing machine having a function of depositing sales proceeds, in the store, and managed an amount of the sales proceeds. In a conventional money depositing machine, for example, when an operation of depositing banknotes is performed, first, the banknotes are deposited in a hopper, and sent one by one into the machine.

A denomination or the like of the banknotes taken into the money depositing machine is identified by a recognition unit. Subsequently, normal notes are stacked in an escrow unit, and rejected banknotes are stacked in a rejecting unit. Based on a storing instruction, the banknotes stacked in the escrow unit are collectively stored in a banknote storing cassette.

It should be noted that, as the money depositing machine as described above, for example, there is known a money depositing machine disclosed in Japanese Patent Laid-Open No. 2001-67526 which is a Japanese patent laid-open application publication.

In such a money depositing machine, if the banknotes are rejected, the rejected banknotes are removed out of the machine from the rejecting unit, and again, inserted into the hopper, taken into the machine and identified. At a time point when all deposited banknotes have been stacked in the escrow unit, the banknotes are stored in the banknote storing cassette. Moreover, the rejected banknotes removed out of the machine from the rejecting unit are separately processed (separately stored), and may also not be stored as the deposited banknotes in the banknote storing cassette.

However, processing the rejected banknotes again in the money depositing machine increases a time required for a money depositing process. Moreover, if the rejected banknotes are separately processed, an amount of the rejected notes needs to be managed separately from an amount of banknotes processed in the money depositing machine. In this way, the conventional money depositing machine has a problem in that the money depositing process cannot be efficiently performed.

It is an object of the present invention to provide a banknote depositing machine which can efficiently perform the money depositing process.

SUMMARY OF THE INVENTION

According to one aspect of the present invention, there is provided a banknote depositing machine comprising:

a receiving unit which takes in inserted banknotes;

a stacking unit which stacks said banknotes;

a transporting unit which transports the banknotes between said receiving unit and said stacking unit;

a recognition unit which is provided in said transporting unit, and identifies and counts the banknotes;

a storing unit which receives the banknotes from said stacking unit and stores the banknotes; and a controlling unit which, if said recognition unit has judged a banknote as abnormal, stops said transporting unit.

According to one aspect of the present invention, there is provided a banknote depositing method using a banknote depositing machine comprising a receiving unit, a transporting unit, a recognition unit provided in said transporting unit, a stacking unit, a storing unit and a controlling unit, wherein:

said receiving unit takes in inserted banknotes, said transporting unit transports the banknotes taken in by said receiving unit to said stacking unit, said recognition unit identifies and counts the banknotes, said stacking unit stacks the banknotes transported by said transporting unit, said storing unit receives the banknotes from said stacking unit and stores the banknotes, and if said recognition unit has judged a banknote as abnormal, said controlling unit stops said transporting unit.

BRIEF DESCRIPTION OF THE DRAWINGS

FIG. 10 is a diagram showing an example of a displaying screen;

DETAILED DESCRIPTION OF THE INVENTION

Hereinafter, embodiments of the present invention will be described based on the drawings.

Figure 1:
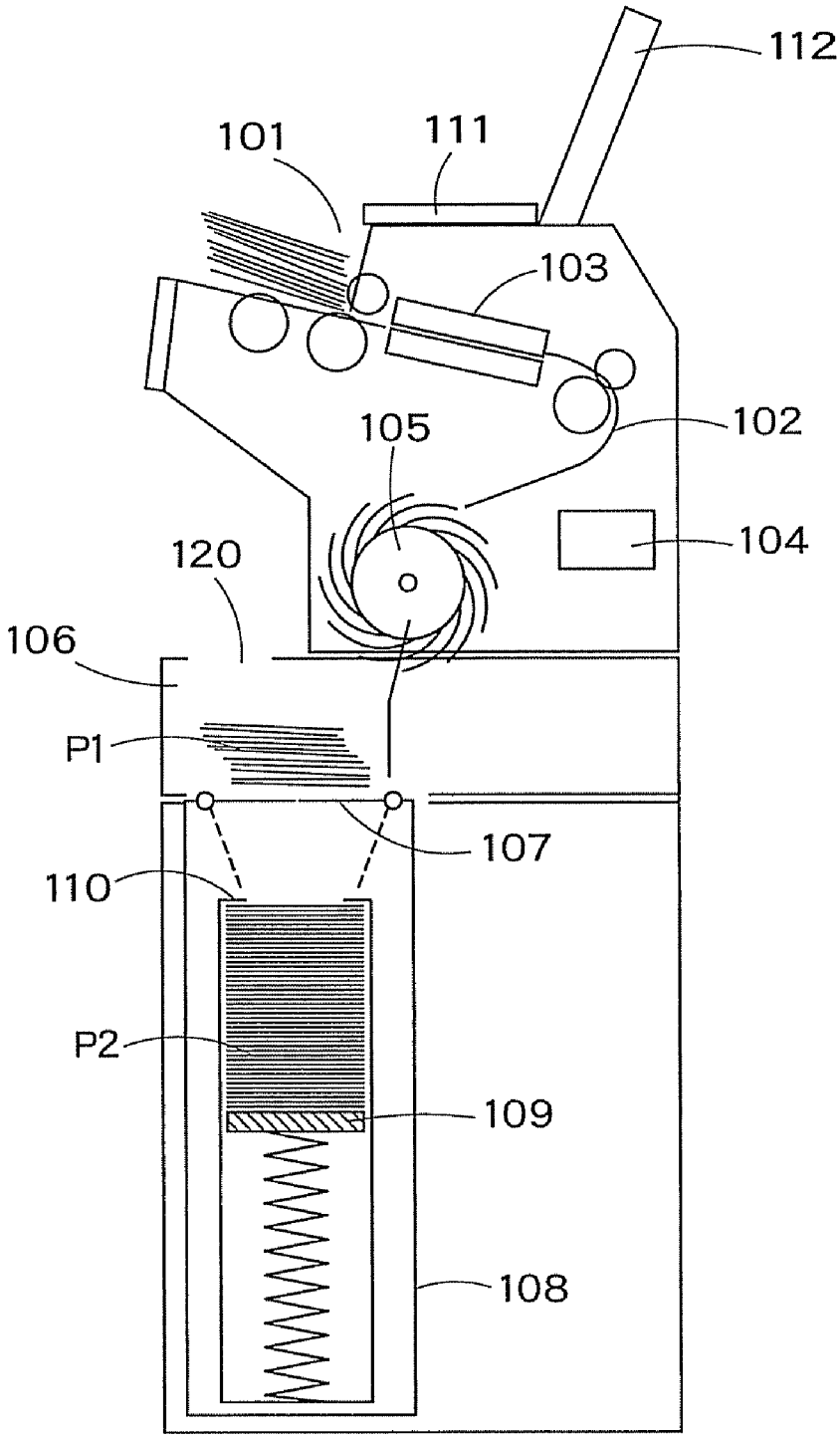
FIG. 1 is a schematic configuration diagram of a banknote depositing machine according to an embodiment of the present invention.
Figure 2:
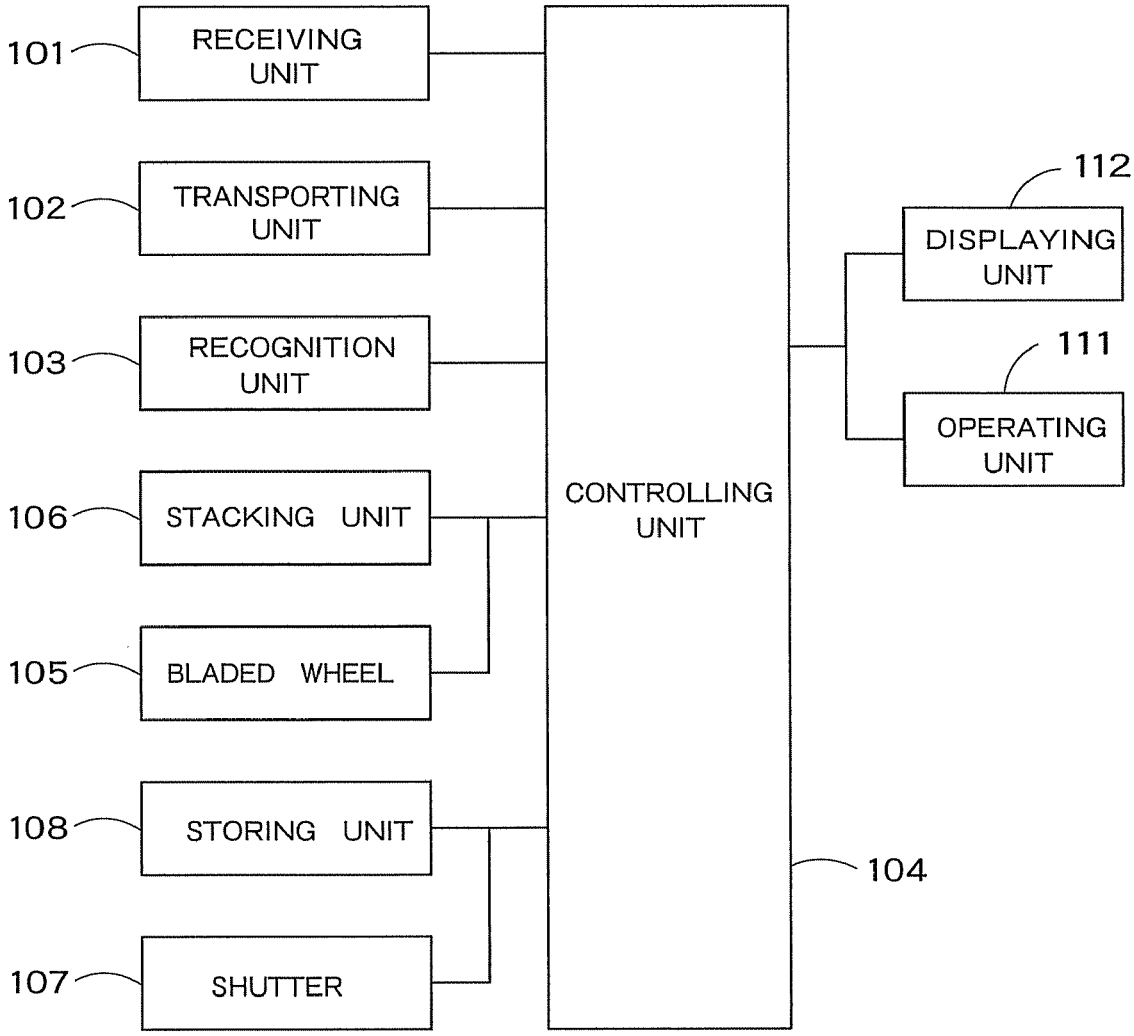
FIG. 2 is a block configuration diagram of the banknote depositing machine according to the same embodiment.

FIG. 1 shows a schematic cross-sectional configuration of a banknote depositing machine according to an embodiment of the present invention, and FIG. 2 shows a functional block diagram. The banknote depositing machine includes a receiving unit 101, a transporting unit 102, a recognition unit 103, a controlling unit 104, a bladed wheel 105, a stacking unit 106, a shutter 107, and a storing cassette 108. Moreover, an operating unit 111 and a displaying unit 112 are connected to the banknote depositing machine.

The receiving unit 101 takes inserted banknotes one by one into the banknote depositing machine. The banknotes taken into the machine are transported by the transporting unit 102. In the transporting unit 102, the recognition unit 103 is provided. The recognition unit 103 identifies and counts the banknotes, and notifies the controlling unit 104 of a identifying and counting result.

The banknotes identified and counted by the recognition unit 103 are transported to the stacking unit 106. The banknotes are aligned by the bladed wheel 105 and stacked in the stacking unit 106. In the stacking unit 106, the transported banknotes are sequentially stacked and stacked. On an upper side of the stacking unit 106, an opening portion 120 is provided so that the stacked banknotes can be easily removed out of the machine.

The banknotes stacked in the stacking unit 106 are stored in the storing cassette 108 based on a storing instruction inputted through the operating unit 111. A method of storing the banknotes in the storing cassette 108 will be described.

When the storing instruction is inputted, the shutter 107 provided on a lower side of the stacking unit 106 is opened, and banknotes P1 stacked in the stacking unit 106 fall onto the storing cassette 108.

In the storing cassette 108, stored banknotes P2 are placed on a placing plate 109, and urged upward. Moreover, both ends of an upper surface of the stored banknotes P2 are pressed by a pair of separators 110.

After the shutter 107 has been opened, a pressing member (not shown) is extended from the stacking unit 106 side to press the banknotes P1 downward. Thereby, the banknotes P1 move below the separators 110, and the banknotes P1 and the stored banknotes P2 are integrated and stored.

After the banknotes P1 have been stored, the pressing member is returned, and the shutter 107 is closed. Such operations of the shutter 107 and the pressing member in association with the storing instruction are controlled by the controlling unit 104.

The banknotes stored in the storing cassette 108 are collected, for example, by a security guard from a security company which has been commissioned to perform a collecting operation, and transferred to a cash processing center.

The controlling unit 104 controls the respective units in the banknote depositing machine. If the recognition unit 103 judges a banknote as abnormal, in association with the transporting of the above described banknote to the stacking unit 106, the controlling unit 104 stops the taking-in of the banknotes by the receiving unit 101 and the transporting of the banknotes by the transporting unit 102.

The recognition unit 103 judges a banknote which is not normal, such as a counterfeit note or an unfit note, as abnormal. Moreover, also if a banknote has not been normally taken in, such as if a banknote is taken in from the receiving unit 101 in a tilted manner, the recognition unit 103 judges the banknote as abnormal. A factor of the judgement that the banknote is abnormal may be displayed on the displaying unit 112.

In the stacking unit 106, the transported banknotes are sequentially stacked. Therefore, the banknote judged as abnormal by the recognition unit 103 is positioned at a top of the stacked banknotes in the stacking unit 106.

If the recognition unit 103 has judged the banknote as abnormal and a process has been suspended, an operator removes the above described banknote out of the stacking unit 106 through the opening portion 120, and checks the banknote. The above described banknote may not be removed out of the stacking unit 106, and visually checked through the opening portion 120.

Figure 3:
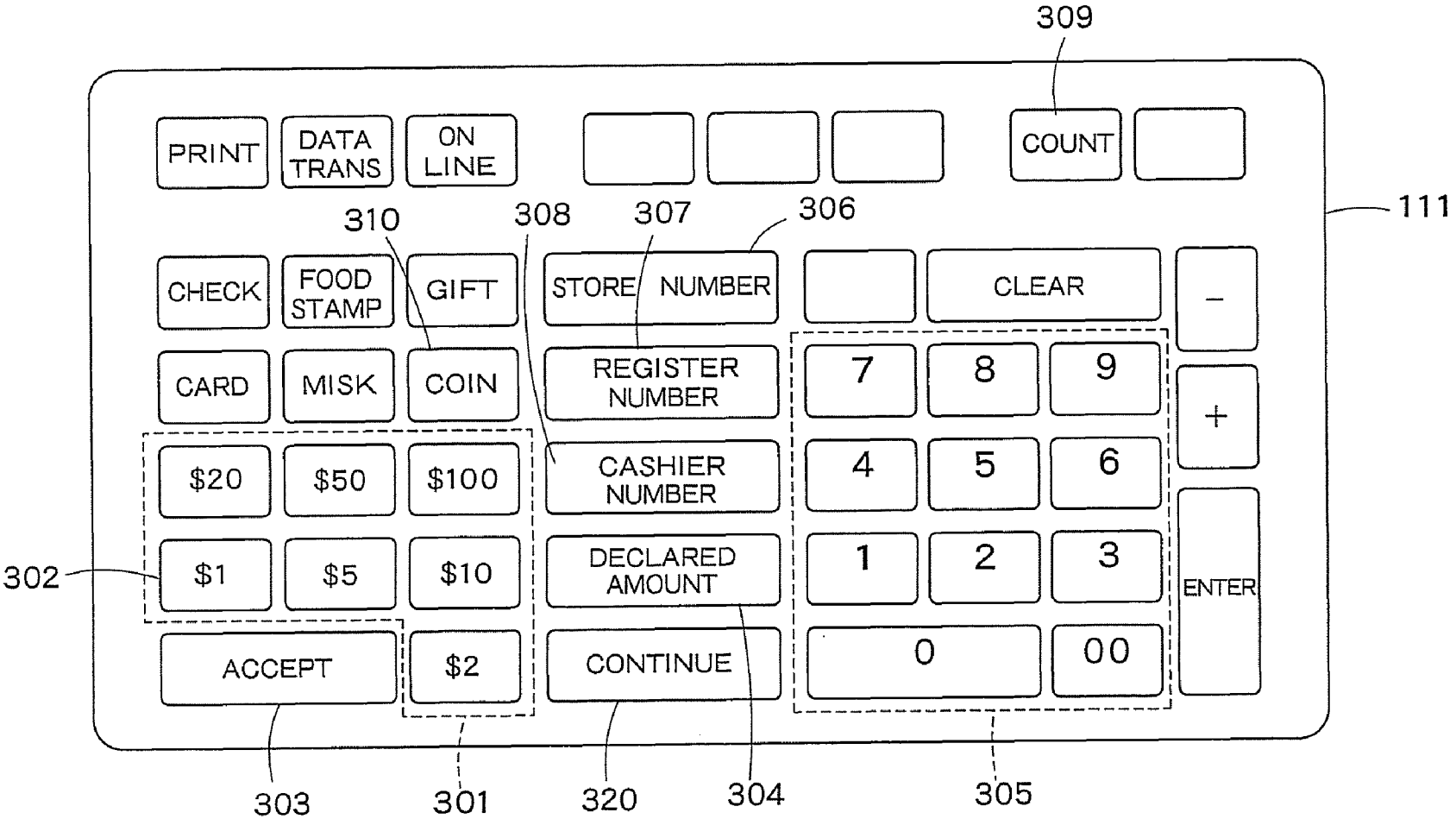
FIG. 3 is a diagram showing an example of an appearance of an operating unit.

Then, if the above described banknote is a genuine note, the operator inputs an amount corresponding to this banknote, from the operating unit 111. For example, the operating unit 111 has a configuration as shown in FIG. 3, and the operator depresses a denomination key 301 corresponding to a denomination of the checked banknote. For example, if the checked banknote has been a one-dollar banknote, the operator depresses a one dollar key 302 on the operating unit 111.

Then, the operator returns the removed banknote from the opening portion 120 to the stacking unit 106, and gives a process resume instruction through the operating unit 111. Based on the process resume instruction, the controlling unit 104 resumes the taking-in of the banknotes by the receiving unit 101 and the transporting of the banknotes by the transporting unit 102.

For example, in response to depression of a CONTINUE key 320 shown in FIG. 3, the controlling unit 104 adds an amount corresponding to the depressed denomination key 301 to an amount of the banknotes counted by the recognition unit 103, and also resumes operations in the respective units.

If the banknote removed out of the stacking unit 106 has not been the genuine note (for example, the banknote has been the counterfeit note), the operator gives the process resume instruction through the operating unit 111, without returning this banknote to the stacking unit 106. The counterfeit note and the like are separately managed.

In this way, at a time point when the banknote has been judged as abnormal, the process is suspended, the operator checks the banknote and inputs the corresponding amount, and the process is resumed.

The banknote judged as abnormal does not need to be inserted into the receiving unit 101 again and processed in the banknote depositing machine. Therefore, a money depositing process can be simplified, and a cost required for the money depositing process can be reduced.

Moreover, the banknote checked by the operator is returned to the stacking unit 106 through the opening portion 120, and stored in the storing cassette 108 along with banknotes which have been normally processed. Therefore, the normally processed banknotes and the banknote judged as abnormal can be collectively managed by the banknote depositing machine, including amount information.

Figure 4:
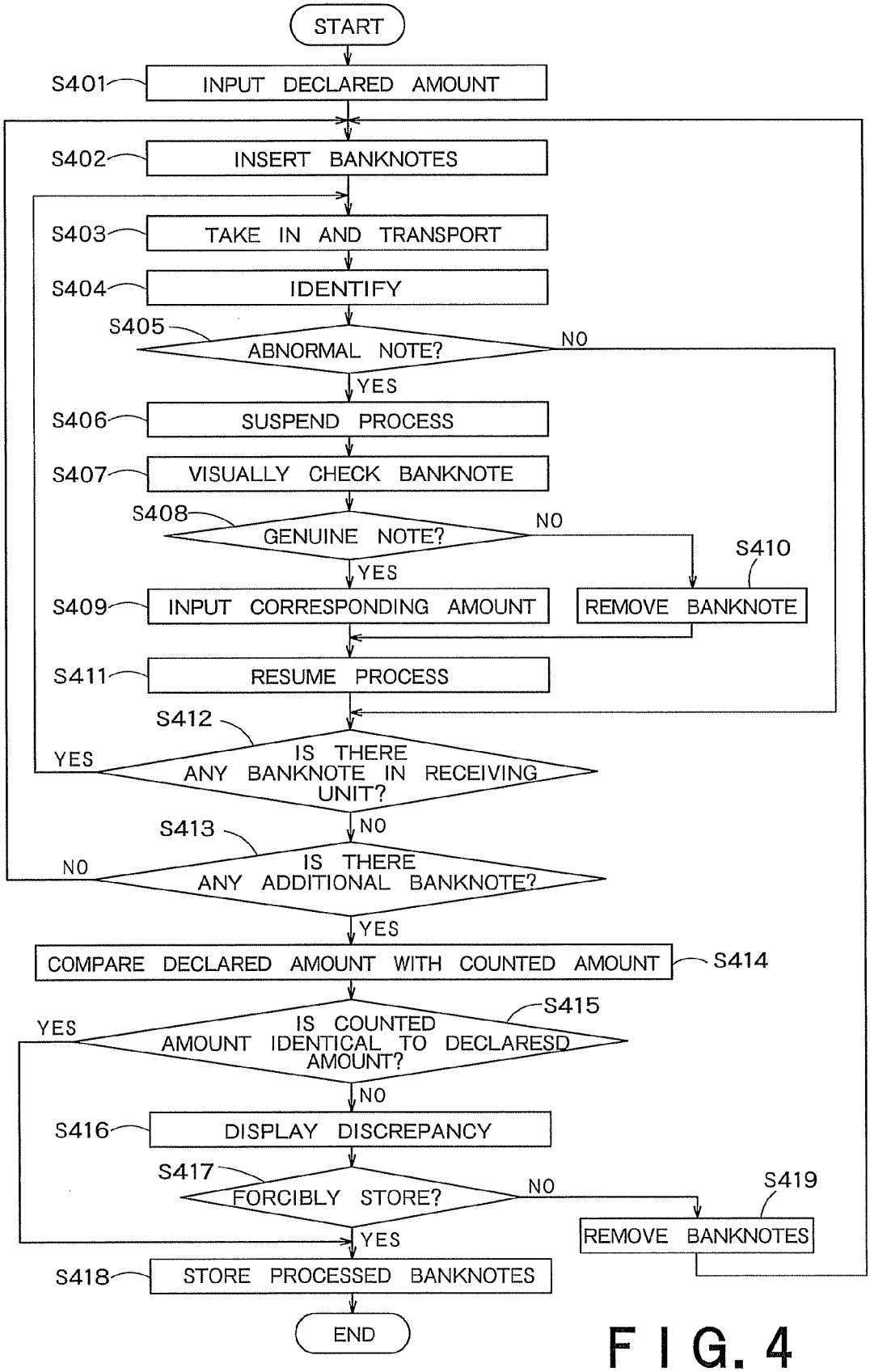
FIG. 4 is a flowchart illustrating a money depositing process according to the same embodiment.

A money depositing process using such a banknote depositing machine will be described by using a flowchart shown in FIG. 4.

(Step S401) A previously known amount of banknotes to be deposited (declared amount) is inputted from the operating unit 111. For example, a DECLARED AMOUNT key 304 shown in FIG. 3 is depressed, and subsequently, a numeric keypad 305 is used to input the declared amount.

Moreover, a STORE NUMBER key 306 may be depressed, and subsequently, the numeric keypad 305 may be used to input a store number.

Moreover, a REGISTER NUMBER key 307 may be depressed, and subsequently, the numeric keypad 305 may be used to input a register number.

Moreover, a CASHIER NUMBER key 308 may be depressed, and subsequently, the numeric keypad 305 may be used to input a cashier number.

Moreover, an OPERATOR NUMBER key may be provided, and the numeric keypad 305 may be used to input an OPERATOR NUMBER of the operator who performs the money depositing process.

Figures 5, 6:
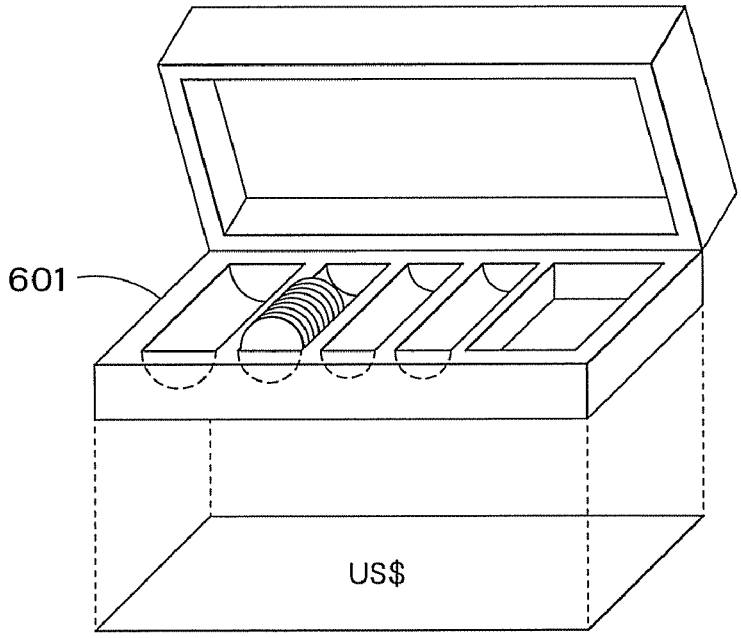
FIG. 5 is a diagram showing an example of a displaying screen.
FIG. 6 is a schematic configuration diagram of a storing box.

When these pieces of information are inputted, a screen as shown in FIG. 5 is displayed on the displaying unit 112.

(Step S402) The banknotes to be deposited are inserted into the receiving unit 101.

(Step S403) The banknote is taken into the machine by the receiving unit 101, and transported by the transporting unit 102.

(Step S404) The recognition unit 103 identifies and counts the banknote. The identified banknote is transported to the stacking unit 106.

(Step S405) If the recognition unit 103 has judged the banknote as abnormal, the process proceeds to step S406, and if the banknote has been able to be normally identified, the process proceeds to step S412.

(Step S406) In association with the transporting of the banknote judged as abnormal by the recognition unit 103 to the stacking unit 106, the controlling unit 104 suspends the money depositing process.

(Step S407) The operator removes the banknote out of the stacking unit 106 through the opening portion 120, or sees the banknote stacked at the top in the stacking unit 106 through the opening portion 120, and checks the banknote.

(Step S408) If the operator has judged that the banknote is the genuine note, the process proceeds to step S409, and if the operator has judged that the banknote is not the genuine note, the process proceeds to step S410.

(Step S409) The operator inputs the amount corresponding to the checked banknote. For example, the operator depresses the denomination key 301 on the operating unit 111.

(Step S410) The operator removes the banknote judged as abnormal by the recognition unit 103, out of the stacking unit 106, and separately manages the banknote judged as abnormal by the recognition unit 103.

(Step S411) For example, the operator depresses the CONTINUE key 320 on the operating unit 111, and thereby gives the process resume instruction. Based on the process resume instruction, the controlling unit 104 resumes the money depositing process.

If the amount has been inputted in step S409, in association with the process resume instruction, the inputted amount is added to the amount counted by the recognition unit 103.

(Step S412) It is detected whether or not any banknote is left in the receiving unit 101. If any banknote is left, the process returns to step S403. If no banknote is left, the process proceeds to step S413.

(Step S413) It is checked whether or not all banknotes related to a transaction have been completely processed. If all banknotes have been completely processed, for example, an ACCEPT key 303 on the operating unit 111 is depressed to input completion of the transaction. If there is any additional banknote, the process returns to step S402, and the additional banknote is inserted.

(Step S414) The amount counted by the recognition unit 103 is compared with the declared amount inputted in step S401. If the operator has inputted the amount in step S409, the amount has also been added to the counted amount.

(Step S415) If a result of the comparison is identical, the process proceeds to step S418, and if the comparison result is not identical, the process proceeds to step S416.

(Step S416) The non-identical comparison result (discrepancy) is displayed on the displaying unit 112.

(Step S417) Although the comparison result is not identical, if the banknotes stacked in the stacking unit 106 are (forcibly) stored, the process proceeds to step S418. For example, if there has been the banknote judged not to be the genuine note in step S408, the banknote is separately managed, and the corresponding amount is not included in the counted amount. If an amount of difference between the counted amount and the declared amount is an amount corresponding to the above described banknote, a reason for the non-identical comparison result is definite, and thus the banknote can be forcibly stored.

If the banknotes stacked in the stacking unit 106 are not forcibly stored, the process proceeds to step S419.

(Step S418) The storing instruction is given through the operating unit 111, and the banknotes stacked in the stacking unit 106 are stored in the storing cassette 108.

(Step S419) The banknotes stacked in the stacking unit 106 are removed through the opening portion 120. Then, the process returns to step S402, and the removed banknotes are inserted into the receiving unit 101, and recounted.

In this way, in the present embodiment, in the middle of the money depositing process, if the abnormal note other than the counterfeit note has been taken in, the process is suspended. The abnormal note is visually checked. The corresponding amount is manually inputted, and added to the counted amount. Then, the process is resumed. Thereby, the money depositing process can be efficiently performed. Moreover, the counterfeit note can be easily removed out of the stacking unit 106 through the opening portion 120.

In the above described embodiment, the money depositing process for the banknotes has been described. However, the money depositing process for paper sheets other than the banknotes, for example, merchandise coupons can also be performed. In this case, after all banknotes are identified and counted, an amount of the merchandise coupons or the like is manually inputted through the operating unit 111. Then, the merchandise coupons or the like are placed on the banknotes stacked in the stacking unit 106, through the opening portion 120.

If the paper sheets include checks, an amount of each check is manually inputted from the operating unit 111, and a printing unit (not shown) prints out a journal in which an amount list, a total amount and the like of the checks have been described. Then, the journal and the checks are bound into one and placed on the banknotes stacked in the stacking unit 106. A check number of each check may also be manually inputted from the operating unit 111 so that the check number is described in the journal.

Subsequently, the storing instruction is given, and thereby the merchandise coupons, the checks or the like are stored in the storing cassette 108 along with the banknotes.

Thereby, the money depositing process can be collectively performed for sales proceeds in the paper sheets other than the banknotes, along with sales proceeds in the banknotes.

Moreover, only the number of the paper sheets other than the banknotes may be counted by using the banknote depositing machine. The number of the paper sheets can be correctly checked. For example, when a COUNT key 309 on the operating unit 111 is depressed, the paper sheets inserted into the receiving unit 101 are taken in, only the number thereof is counted, and the paper sheets are stacked in the stacking unit 106. The counted number of the paper sheets is displayed on the displaying unit 112.

A storing box 601 which stores coins, as shown in FIG. 6, may be used to perform the money depositing process for the coins along with the banknotes. The storing box 601 has a size equal to the banknotes.

In this case, after all banknotes to be deposited are identified and counted, a total amount of the coins is manually inputted through the operating unit 111. For example, after a COIN key 310 is depressed, the numeric keypad 305 is used to input the total amount or the number of each denomination of the coins.

Then, the storing box 601 which has stored the coins is placed on the banknotes stacked in the stacking unit 106, through the opening portion 120. Subsequently, the storing instruction is given, and thereby the storing box 601 is stored in the storing cassette 108 along with the banknotes.

Thereby, the money depositing process can be collectively performed for sales proceeds in the coins, along with the sales proceeds in the banknotes.

Figure 7:
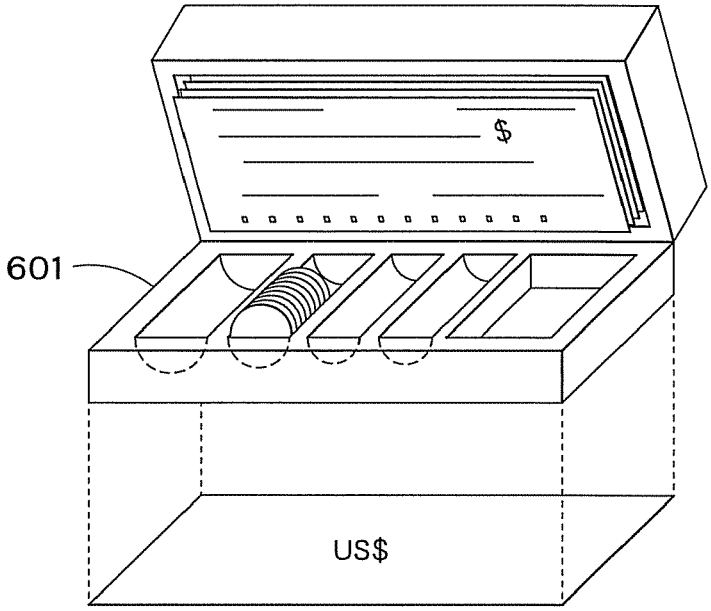
FIG. 7 is a schematic configuration diagram of a storing box.

As shown in FIG. 7, not only the coins but also the paper sheets other than the banknotes, such as the merchandise coupons or the checks, may be stored in the storing box 601. Such a storing box 601 can also be used to perform the money depositing process for valuable media other than the banknotes, along with the banknotes.

Figure 8:
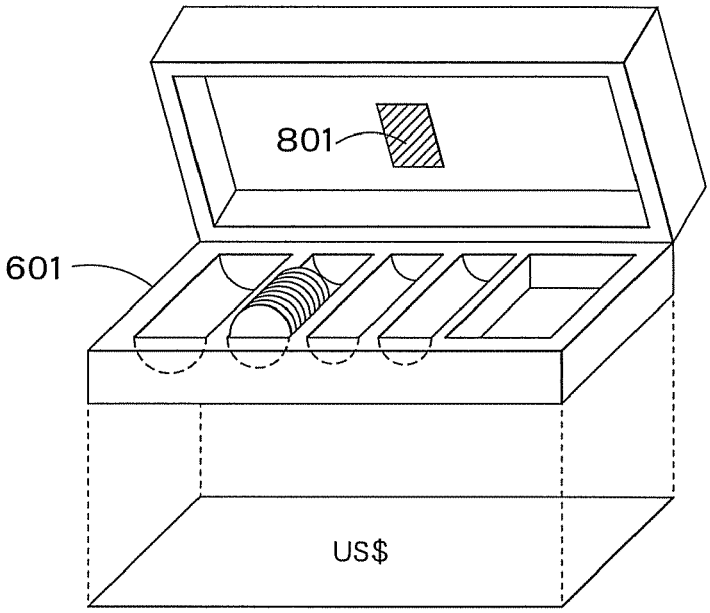
FIG. 8 is a schematic configuration diagram of the storing box provided with an IC tag.
Figure 9:
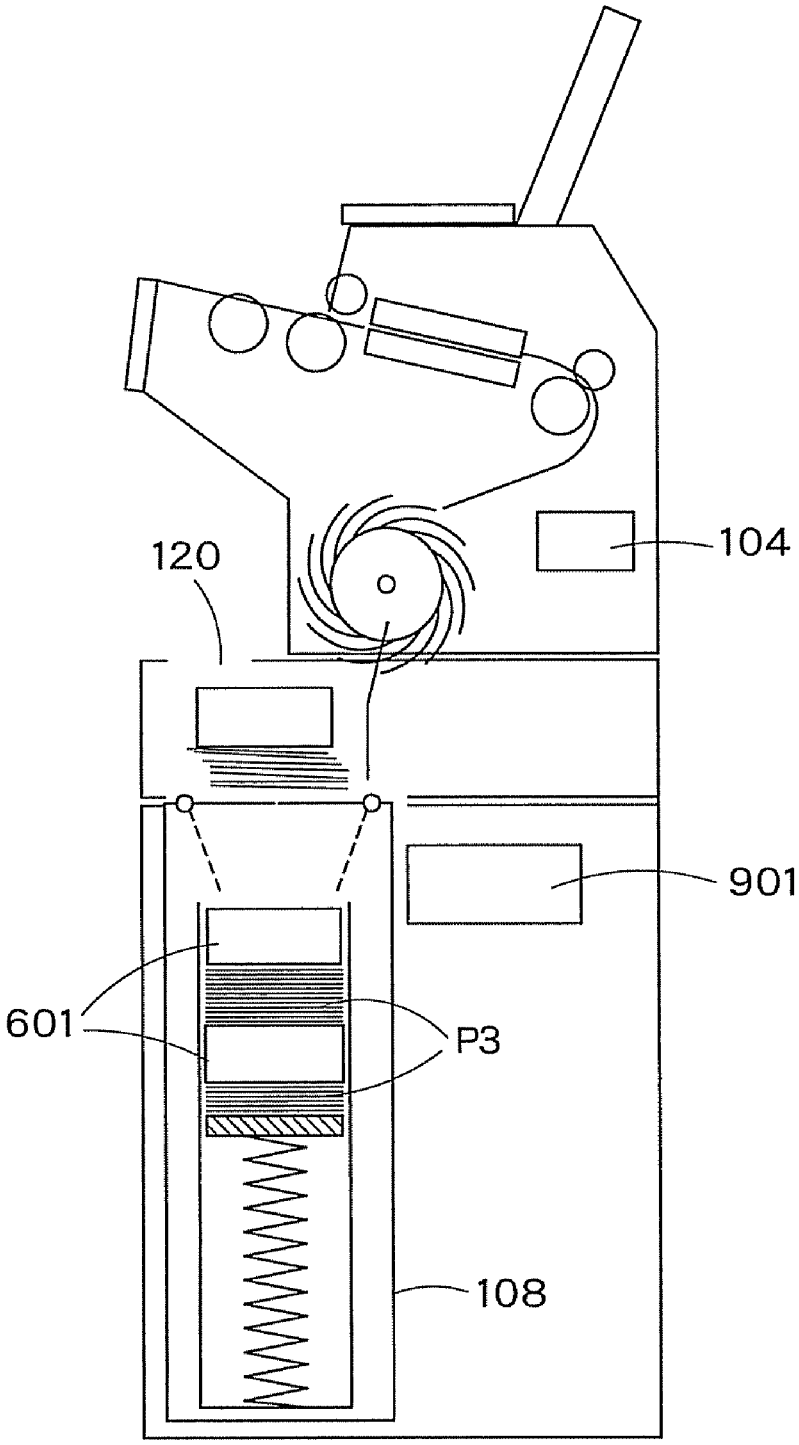
FIG. 9 is a schematic configuration diagram of the banknote depositing machine according to a variation.

Moreover, as shown in FIG. 8, an IC tag 801 in which transaction information such as the store number, the register number and the cashier number have been stored, may be provided in the storing box 601. If the money depositing process is performed with the banknotes and the storing box 601, as shown in FIG. 9, banknotes P3 and the storing box 601 are alternately stored in the storing cassette 108. In other words, the storing box 601 plays a similar role as a separator card which separates the banknotes in units of the money depositing processes.

In the cash processing center which has collected the storing cassette 108, it is possible to easily recognize which money depositing process the banknotes under each storing box 601 in the storing cassette 108 correspond to, by reading the transaction information in the IC tag 801.

Moreover, as shown in FIG. 9, a tag reader 901 may be provided at a side portion of the storing cassette 108, and the IC tag 801 may store a number unique to each storing box 601. When the storing box 601 is stored in the storing cassette 108, the storing box 601 passes near the tag reader 901. At this time, the tag reader 901 reads the unique number stored in the IC tag 801 and notifies the controlling unit 104 of the unique number.

The controlling unit 104 associates this unique number with money depositing process information, and stores them in a storing unit (not shown). In the cash processing center which has collected the storing cassette 108, it is possible to easily recognize which money depositing process the banknotes under each storing box 601 in the storing cassette 108 correspond to, by using the unique number read from the IC tag 801 and the unique number associated with the money depositing process information obtained from the banknote depositing machine.

Instead of the unique number, the transaction information as described above may be stored in the IC tag 801, and the tag reader 901 may read the transaction information and notify the controlling unit 104 of the transaction information. The controlling unit 104 associates the transaction information notified by the tag reader 901, the counting result provided by the recognition unit 103, and manually inputted information on the valuable media in the storing box with one another, and stores them in the storage unit (not shown).

If the storing box 601 is used to perform the money depositing process for the valuable media other than the banknotes, such as the coins or the checks, a screen as shown in FIG. 10 is displayed on the displaying unit 112.

Figure 11:
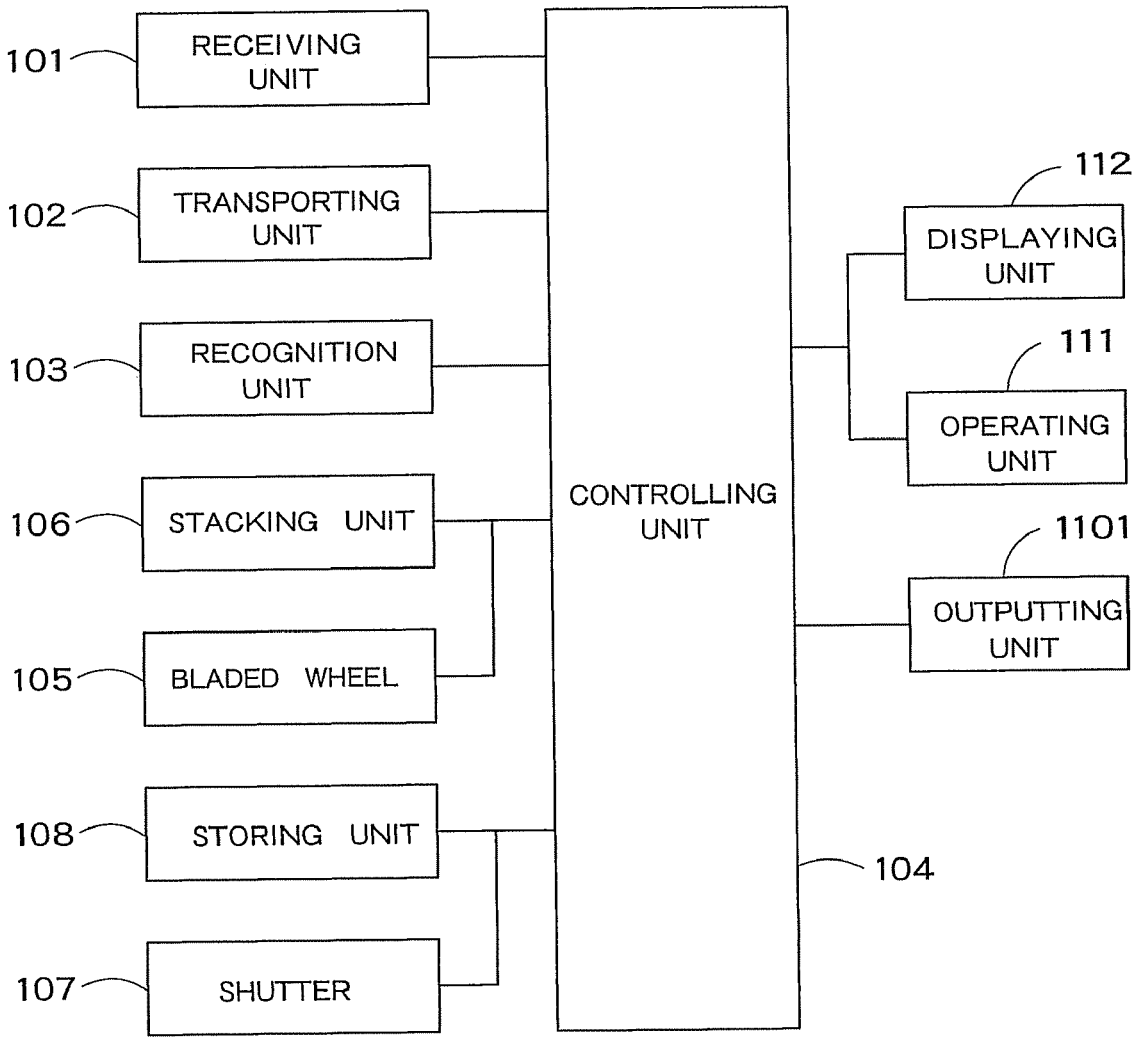
FIG. 11 a block configuration diagram of the banknote depositing machine according to a variation.

As shown in FIG. 11, the banknote depositing machine according to the above described embodiment may further include an outputting unit 1101 which can output a deposited amount of the banknotes or the like stored in the storing cassette 108, to outside. For example, in association with the storing of the deposited banknotes in the storing cassette 108, the outputting unit 1101 may output the deposited amount to a bank server, and complete depositing money in a bank account.

Figure 12:
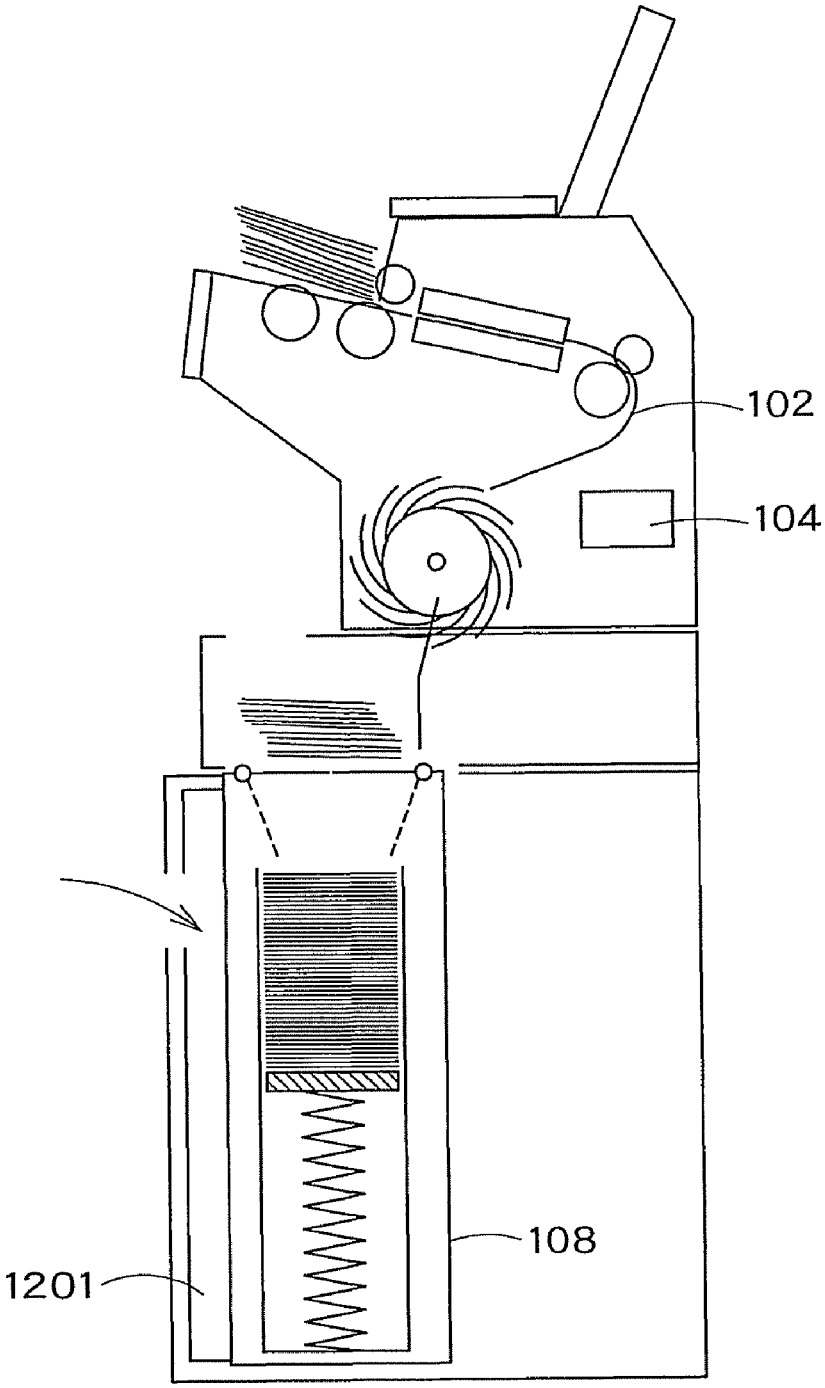
FIG. 12 is a schematic configuration diagram of the banknote depositing machine according to a variation.

As shown in FIG. 12, the banknote depositing machine according to the above described embodiment may be configured to further include a storing unit 1201 into which the valuable media other than the banknotes, such as the merchandise coupons or the checks, can be inserted from outside the machine. The storing unit 1201 is collected along with the storing cassette 108, and transferred to the cash processing center.

The abnormal note removed out of the stacking unit 106 through the opening portion 120 may be inserted into the storing unit 1201. Moreover, a detecting unit (not shown) which detects the insertion of the abnormal note may be provided at the opening portion 120, and based on the detecting of the insertion of the abnormal note by the detecting unit, the controlling unit 104 may resume the money depositing process.

In the above described embodiment, the banknote judged as abnormal has been visually checked, and the corresponding amount has been inputted. Subsequently, the process resume instruction has been given, and thereby the suspended money depositing process has been resumed. However, the input of the amount may also serve as the process resume instruction. For example, the depression of the denomination key 301 may resume the process. Thereby, the money depositing process is further efficiently performed.

In the above described embodiment, if the recognition unit 103 judges the banknote as abnormal, in association with the stack of the abnormal note onto the stacked banknotes in the stacking unit 106, the controlling unit 104 has stopped the taking-in of the banknotes by the receiving unit 101 and the transporting of the banknotes by the transporting unit 102. However, the stop may be performed before the abnormal note is stacked onto the stacked banknotes. For example, the controlling unit 104 controls to stop the respective units when the abnormal note is on the bladed wheel 105.

Moreover, in the above described embodiment, the abnormal note has been visually checked through the opening portion 120. However, a scanning unit (not shown) which scans the abnormal note may be provided on the transporting unit 102, and a scanned image may be displayed on the displaying unit 112. The operator checks the denomination of the abnormal note based on the scanned image displayed on the displaying unit 112, and inputs the amount or the denomination from the operating unit 111.

The scanned image may be stored in the storing unit (not shown), and may be deleted after the amount or the denomination is inputted. In association with the deletion of the scanned image, the controlling unit 104 may resume the money depositing process.

In the above described embodiment, the amount or the denomination of the abnormal note which has been visually checked has been inputted, and the inputted amount has been added to the amount counted by the recognition unit 103. However, the controlling unit 104 may separately process the manually inputted amount of the abnormal note and the amount counted by the recognition unit 103.

The present invention is not limited to what has been described in the above embodiments but may be embodied with its elements modified in practice without departing from the spirit thereof. Also, various aspects of the present invention may be made in appropriate combinations of elements disclosed in the above embodiments. For example, some elements may be removed from all the elements set forth in the embodiments. Further, elements from different embodiments may be appropriately combined.

What is claimed is:

1. A banknote depositing machine comprising:

a receiving unit which takes in inserted banknotes;

a stacking unit which stacks said banknotes;

a transporting unit which transports the banknotes between said receiving unit and said stacking unit;

a recognition unit which is provided in said transporting unit, and identifies and counts the banknotes;

a storing unit which receives the banknotes from said stacking unit and stores the banknotes;

a controlling unit which, if said recognition unit has judged a banknote as abnormal, stops said transporting unit; and an instruction accepting unit which accepts a storing instruction that causes the banknotes stacked in said stacking unit to be stored in said storing unit, wherein an opening portion through which the banknotes judged to be abnormal can be removed is formed in said stacking unit.

2. The banknote depositing machine according to claim 1, further comprising:

an inputting unit through which information regarding said abnormal note can be inputted, wherein said controlling unit processes at least any one of the information inputted through said inputting unit and an amount counted by said recognition unit.

3. The banknote depositing machine according to claim 2, wherein:

based on the input through said inputting unit, said controlling unit resumes the transporting of the banknotes by said transporting unit.

4. The banknote depositing machine according to claim 1, wherein:

said controlling unit stops said transporting unit before said abnormal note is stacked onto stacked banknotes in said stacking unit.

5. The banknote depositing machine according to claim 1, further comprising:

an instruction accepting unit which accepts a paper sheet counting instruction, wherein if said instruction accepting unit has accepted said counting instruction, said controlling unit processes information on the number of paper sheets which have been inserted into said receiving unit and have been identified and counted by said recognition unit.

6. The banknote depositing machine according to claim 1, wherein:

said opening portion is configured to be able to receive a storing box which stores at least any one of paper sheets or coins, and said storing unit can store said storing box received through said opening portion.

7. The banknote depositing machine according to claim 6, further comprising:

a communicating unit which enables data transmission and reception between said storing box and said controlling unit.

8. The banknote depositing machine according to claim 7, wherein:

said communicating unit is an IC tag reader which reads information regarding at least any one of the paper sheets or the coins stored in said storing box, from an IC tag which stores said information and is provided in said storing box.

9. The banknote depositing machine according to claim 7, wherein:

said communicating unit is an IC tag reader which reads transaction information on a transaction including the banknotes inserted into said receiving unit, from an IC tag which stores said transaction information and is provided in said storing box, said controlling unit associates information including a counting result provided by said recognition unit with said transaction information, and said storing unit stores said storing box on said banknotes.

10. The banknote depositing machine according to claim 1, further comprising:

an outputting unit which can output information including a counting result provided by said recognition unit.

11. The banknote depositing machine according to claim 1, further comprising:

a second storing unit which can store said abnormal note.

12. The banknote depositing machine according to claim 11, further comprising:

a detecting unit which detects insertion of the banknotes into said second storing unit, wherein if said detecting unit detects that said abnormal note has been inserted into said second storing unit, said controlling unit resumes the transporting of the banknotes by said transporting unit.

13. A banknote depositing method using a banknote depositing machine comprising a receiving unit, a transporting unit, a recognition unit provided in said transporting unit, a stacking unit, an opening portion formed in the stacking unit, a storing unit, an instruction accepting unit and a controlling unit, wherein:

said receiving unit takes in inserted banknotes, said transporting unit transports the banknotes taken in by said receiving unit to said stacking unit, said recognition unit identifies and counts the banknotes, said stacking unit stacks the banknotes transported by said transporting unit, if said instruction accepting unit accepts a storing instruction, the banknotes stacked in said stacking unit are then sent to said storing unit, whereby said storing unit receives the banknotes from said stacking unit and stores the banknotes in said storing unit according to the storing instruction, and if said recognition unit has judged a banknote as abnormal, said controlling unit stops said transporting unit and the banknote judged abnormal and stacked in said stacking unit is then removed through the opening portion.

14. A banknote depositing machine comprising:

a receiving unit which takes in inserted banknotes;

a stacking unit which stacks said banknotes;

a transporting unit which transports the banknotes between said receiving unit and said stacking unit;

a recognition unit which is provided in said transporting unit, and identifies and counts the banknotes;

a storing unit which receives the banknotes from said stacking unit and stores the banknotes;

a controlling unit which, if said recognition unit has judged a banknote as abnormal, stops said transporting unit;

a second storing unit which can store said abnormal note; and a detecting unit which detects insertion of the banknotes into said second storing unit, wherein an opening portion through which the backnotes judged to be abnormal can be removed is formed in said stacking unit, and if said detecting unit detects that said abnormal note has been inserted into said second storing unit, said controlling unit resumes the transporting of the banknotes by said transporting unit.

* * * * *